US010638558B2

(12) United States Patent
Sclocchi et al.

(10) Patent No.: US 10,638,558 B2
(45) Date of Patent: Apr. 28, 2020

(54) APPARATUS FOR SIMULTANEOUSLY HEATING A PLURALITY OF FOOD PRODUCTS

(71) Applicant: ILLINOIS TOOL WORKS, INC., Glenview, IL (US)

(72) Inventors: Michele Sclocchi, San Donato Milanese (IT); Christine Rollet, Evanston, IL (US); Marco Carcano, Senago (IT); Marco Bullo, Scorzé (IT); Francesco Gambato, San Giorgio in Bosco (IT)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 475 days.

(21) Appl. No.: 15/430,579

(22) Filed: Feb. 13, 2017

(65) Prior Publication Data

US 2017/0295614 A1 Oct. 12, 2017

Related U.S. Application Data

(60) Provisional application No. 62/319,941, filed on Apr. 8, 2016.

(51) Int. Cl.

| | |
|---|---|
| ***H05B 6/66*** | (2006.01) |
| ***H05B 6/62*** | (2006.01) |
| ***F25D 31/00*** | (2006.01) |

(52) U.S. Cl.

CPC ..... *H05B 6/664* (2013.01); *F25D 31/005* (2013.01); *H05B 6/62* (2013.01); *F25D 2400/02* (2013.01)

(58) Field of Classification Search

CPC ..... H05B 6/664; H05B 6/105; H05B 6/1236; H05B 6/46; H02J 17/00; A47J 37/0676

(Continued)

(56) References Cited

U.S. PATENT DOCUMENTS 2,434,573 A 6/1948 Mann et al.
4,004,229 A * 1/1977 File ..... H04B 1/088 336/233

(Continued)

FOREIGN PATENT DOCUMENTS

CH 245524 A 11/1946
JP 2003332037 A 11/2003

(Continued)

OTHER PUBLICATIONS

International Search Report and Written Opinion of PCT/US2017/025902 filed Jun. 29, 2017, all enclosed pages cited.

*Primary Examiner* — Dana Ross
*Assistant Examiner* — Joe E Mills, Jr.
(74) *Attorney, Agent, or Firm* — Burr & Forman, LLP

(57) ABSTRACT

An apparatus for simultaneously heating a plurality of food products, comprising: a containment structure forming a housing chamber; one or more separating elements mounted in the housing chamber to delimit a plurality of separate housing compartments for receiving the food products; radio frequency dielectric heating means with an operating frequency of between 1 MHz and 300 MHz, mounted in the containment structure and comprising at least one first electrode and one second electrode; wherein the housing compartments are aligned along a row, the first electrode and the second electrode delimiting on two opposite sides the row; and wherein inside the housing chamber, between the first electrode and the second electrode, there is also at least one inductor.

18 Claims, 2 Drawing Sheets

(58) Field of Classification Search
USPC ..... 219/764, 623, 618, 677, 769, 770, 771, 219/788
See application file for complete search history.

(56) References Cited

U.S. PATENT DOCUMENTS

| | | | | | |
|---|---|---|---|---|---|
| 4,296,299 | A * | 10/1981 | Stottmann | H05B 6/62 | 219/771 |
| 4,511,869 | A * | 4/1985 | Snyder | H03J 7/16 | 334/20 |
| 4,910,371 | A * | 3/1990 | Brun | H05B 6/62 | 219/771 |
| 6,323,473 | B1 * | 11/2001 | Yamamoto | A23L 3/01 | 219/771 |
| 6,812,445 | B2 * | 11/2004 | Gorbold | H05B 6/54 | 219/764 |
| 8,803,045 | B2 * | 8/2014 | Cadima | H01F 38/14 | 219/618 |
| 2002/0084027 | A1 * | 7/2002 | Terano | B29C 65/3656 | 156/272.4 |
| 2017/0055769 | A1 * | 3/2017 | Grimaldi | A47J 37/0629 | |

FOREIGN PATENT DOCUMENTS

| | | | |
|---|---|---|---|
| WO | 8804127 | A2 | 6/1988 |
| WO | 2015005793 | A1 | 1/2015 |
| WO | 2016008868 | A1 | 1/2016 |

* cited by examiner

APPARATUS FOR SIMULTANEOUSLY HEATING A PLURALITY OF FOOD PRODUCTS

CROSS-REFERENCE TO RELATED APPLICATIONS

This application claims priority to U.S. provisional application No. 62/319,941 filed Apr. 8, 2016, the entire contents of which are hereby incorporated by reference.

TECHNICAL FIELD

This disclosure relates in general to the heating of food products, in particular in the catering sector for preparing food by cooking. In more detail, this disclosure relates to an apparatus for simultaneously heating a plurality of food products. In yet more detail, it relates to the simultaneous thawing of a plurality of deep-frozen food products.

BACKGROUND

The technical solution which forms the subject matter of this disclosure was initially developed with reference to the sector of simultaneous thawing of a plurality of deep-frozen food products, but it may advantageously be applied in general for heating food products for any purpose. However, for simplicity, hereinafter reference will mainly be made to the thawing sector.

In the catering sector, in particular in that of fast food, some food products, to be used for preparing various foods, are initially available deep-frozen and a predetermined quantity of them is thawed in advance on a daily basis so that it is available when required.

Whilst the deep-frozen products awaiting use are preserved in suitable cold storage rooms able to preserve them at relatively low temperatures (approximately at least −18° C.), those that must be thawed daily are usually taken out of the cold storage rooms a day early and are placed in suitable thawing apparatuses.

In large catering restaurant chains, where the entire procedure is highly standardized, the deep-frozen food products are supplied to each point of sale packaged in packages having practically constant dimensions and weight. For example, hamburgers may be packaged in packages containing several dozen pieces stacked and positioned side by side in such a way as to constitute an almost parallelepiped block. Therefore, in large fast food restaurant chains, on a daily basis the point of sale thaws a predetermined number of blocks of hamburgers, in order to meet the foreseeable customer demand.

According to the most widespread prior art in catering, the thawing of food products is carried out in suitable apparatuses, appropriately designed for that purpose. In the most widespread embodiments, such apparatuses are substantially refrigerators combined with a generator of air at a controlled temperature (normally between 0° C. and 20/25° C.) which have a plurality of housing compartments in which the deep-frozen food products can be inserted. The actual thawing is performed by circulating air at a controlled temperature (a temperature that generally at the start is equal to 20/25° C. and that is gradually reduced to approximately 0/2° C. during the process). Once thawing is complete or almost complete, a refrigerating circuit begins operating, designed to preserve the foods at a temperature of approximately 0/2° C. Generally, such apparatuses are able to thaw food products over a period of many hours (in many cases just under twenty-four hours), therefore, every day the point of sale must empty the thawed products from the apparatus (which are then advantageously preserved in normal refrigerators until they are used) and load the apparatuses with new products to be thawed.

In the case of deep-frozen food products with standardized packaging, it is also generally the case that, to minimize overall dimensions, each housing compartment of the prior art apparatuses has a volume that is made to measure for the block to be thawed, that is to say, slightly larger than that of the block.

It is easy to see how this technology has considerable limits and may therefore cause significant disadvantages.

In particular, the thawing times are long and make dynamic management of the food products depending on the actual customer demand impossible. Each point of sale must plan one day, how many food products it must thaw for the next day. If demand is overestimated, at the end of the following day the point of sale will have to dispose of the excess products as rubbish. If, on the other hand, the demand is underestimated, at a certain point during the following day, the point of sale will be unable to meet customer demand.

Faced with these issues, points of sale would generally prefer to overestimate demand, with the consequent risk of wasting a predetermined number of food products, rather than risk disappointing the customers.

There are also known, at least at a documented level (see for example U.S. Pat. No. 4,296,299 or JP H05 41971), apparatuses for thawing food that use radio frequency dielectric heating, and that have the theoretical advantage of allowing heat generation inside the deep-frozen food products, with a consequent improvement as regards thawing times. However, such apparatuses have not yet actually spread much at a commercial level, probably due to the technical difficulties involved, especially as regards the need to thaw the food products without running the risk of locally cooking them and the difficulty in obtaining good efficiency (in fact, there is a real risk that even 90% of the energy consumed will be dissipated in the form of heat in the electromagnetic field generator, rather than in the products to be thawed). Moreover, all of the prior art solutions of this type deal exclusively with the subject of thawing a single product (or block of products), and not that of thawing multiple products, as is required in the catering sector.

In this context, there is a real need to produce an apparatus for simultaneously heating a plurality of food products which overcomes the above-mentioned disadvantages.

In particular, there is the need to produce an apparatus for simultaneously heating a plurality of food products that allows the products to be thawed more rapidly than the prior art apparatuses.

Furthermore, there is the need to produce an apparatus for simultaneously heating a plurality of food products that allows the products to be thawed in a controlled way, that is to say, avoiding excessively overheating them even in the case of particularly rapid thawing operations.

Moreover, the need is felt to produce an apparatus for simultaneously heating a plurality of food products that has a relatively high level of efficiency.

BRIEF SUMMARY OF SOME EXAMPLE EMBODIMENTS OF THE SUBJECT OF THE PRESENT DISCLOSURE

In accordance with this disclosure, said requirements have been met thanks to an apparatus for simultaneously heating a plurality of food products as described in the appended claims. Said apparatus may advantageously be intended both for thawing and for heating for other reasons (cooking, etc.).

In particular, said requirements have been met with an apparatus in which a plurality of food products (deep-frozen or not) can be placed in a plurality of separate housing compartments, where the housing compartments are positioned in a row between two electrodes which generate an electromagnetic field with a frequency within the radio frequency dielectric heating band, and where in the space between the two electrodes there is one or more inductors designed to compensate for, at the operating frequency, completely or partly, the imaginary part of a capacitive impedance that the apparatus would have in use in their absence.

In particular, in accordance with several preferred embodiments, the apparatus comprises:

- a containment structure that inside it forms a housing chamber and that is equipped with at least one openable and closable access door for allowing or not access from the outside to the housing chamber;
- one or more separating elements mounted in the housing chamber, the separating elements delimiting in the housing chamber a plurality of separate housing compartments for receiving the food products;
- radio frequency dielectric heating means, mounted in the containment structure and, in turn, comprising at least one first electrode and one second electrode, and a power supply device, electrically connected to them, for applying between the first electrode and the second electrode a variable electric potential difference with an operating frequency of between 1 MHz and 300 MHz;

wherein

- the housing compartments are aligned along a first direction and form a row of housing compartments that extends from a first housing compartment to a final housing compartment;
- the one or more separating elements extend mainly perpendicularly to the first direction;
- the first electrode and the second electrode each extend mainly in a plane perpendicular to the first direction, facing each other and the one or more separating elements and delimit on two opposite sides the row of housing compartments;
- the separating elements are positioned between the first electrode and the second electrode;
- the first housing compartment is delimited, on two opposite sides, respectively by the first electrode and by a separating element;
- the final housing compartment is delimited, on two opposite sides, respectively by the second electrode and by a separating element; and
- inside the housing chamber, between the first electrode and the second electrode, there is also at least one inductor present, electrically insulated both relative to the first electrode and relative to the second electrode.

In accordance with the preferred embodiments, the at least one inductor is advantageously positioned at one or more separating elements, preferably at each separating element.

Moreover, advantageously, each inductor present is made and positioned in such a way as to be affected by/link the variable electromagnetic field that is generated between the first electrode and the second electrode and, in this way, in use is an inductive electric load for the power supply device.

In one embodiment the inductor comprises a coil of electric conductor wire with surface insulation (either from painting or from a coating), preferably wound around a main axis that is perpendicular to the electrodes.

In one embodiment the separating element with which the inductor is combined comprises a first conductive element and a second conductive element which lie in two planes that are parallel to each other, which are held at a distance from each other and which are facing two adjacent housing compartments separated by the separating element to which they belong. In this case, the inductor may be electrically connected in series between the first conductive element and the second conductive element and therefore may be placed inside the dimensions of the separating element.

Regarding the sizing of the inductor, there are various possibilities. In general, the sizing will be determined considering the operating condition of the apparatus in which the power supply device applies an electric potential difference between the first electrode and the second electrode with a specific operating frequency, and sizing the inductance that the inductor constitutes for the power supply device. Therefore, said inductance may be such that it compensates for, completely, or partly or in excess, an imaginary part of a capacitive impedance of, in use, each of the one or more separating elements. Alternatively, said inductance may be such that it compensates for, completely, or partly or in excess, an imaginary part of a capacitive impedance of, in use, jointly a plurality of separating elements (advantageously all). Moreover, said inductance may be such that it compensates for, completely, partly or in excess, an imaginary part of a capacitive impedance that, in use, is present between the first and second electrodes. Furthermore, said inductance may be such that it compensates for, completely, partly or in excess, an imaginary part of a capacitive impedance of, in use, each housing compartment. In preferred embodiments, in particular, such compensating is obtained by sizing the inductor in such a way that it has an impedance whose imaginary part has an absolute value of between 0.5 and 2 times the absolute value of the imaginary part of the capacitive impedance that it must compensate for, more preferably approximately about 1 time (to minimize external compensation).

Depending on the embodiments, the inductor may either have a constant inductance, or it may have an adjustable inductance, for example, modifying its coupling to the electromagnetic field which is established between the two electrodes (for example, obtainable by varying the inclination of the above-mentioned main axis or providing movable ferrite cores coupled to it). In all of the cases of adjustable impedance, there may be a motor-driven device present for adjusting the inductance of the inductor, and an electronic control system operatively connected to the motor-driven device for controlling it and checking its operation.

According to several preferred embodiments of this disclosure, intended for thawing food products, the apparatus may also comprise a refrigerating circuit associated with the housing chamber for refrigerating it to keep it at a temperature close to the end of thawing maintenance temperature (that is to say, approximately 0/2° C.). Depending on the cases, the refrigerating circuit may have any structure suitable for the purpose and comprises the use of one or more evaporators associated with the housing chamber. For example, the refrigerating circuit may comprise one or more evaporators positioned in one or more of the separating elements, and/or an evaporator combined with a wall of the housing chamber.

Furthermore, in some example embodiments the separating elements may be fixed, in others they may be movable or removable. In this latter case, the separating elements may either adopt only predetermined positions in the housing chamber, or they may be movable in such a way as to allow variation of the dimensions of the individual housing compartments.

It may also be the case that, in some embodiments, at least one of either the first electrode or the second electrode is movable relative to the other for varying their distance from each other and so changing the size of one or more housing compartments and/or the number of housing compartments.

Depending on requirements, all of the housing compartments may be either substantially the same size along a predetermined direction or substantially the same two-dimensional or three-dimensional size.

BRIEF DESCRIPTION OF THE DRAWINGS

Further features and the advantages of this disclosure are more apparent in the detailed description of a preferred, non-limiting embodiment of an apparatus for simultaneously heating a plurality of food products illustrated in the accompanying drawings, in which.

DETAILED DESCRIPTION OF EXAMPLE EMBODIMENTS

With reference to the accompanying drawings, the numeral 1 denotes in its entirety an apparatus for simultaneously heating a plurality of food products 2, according to this disclosure.

Figure 1:
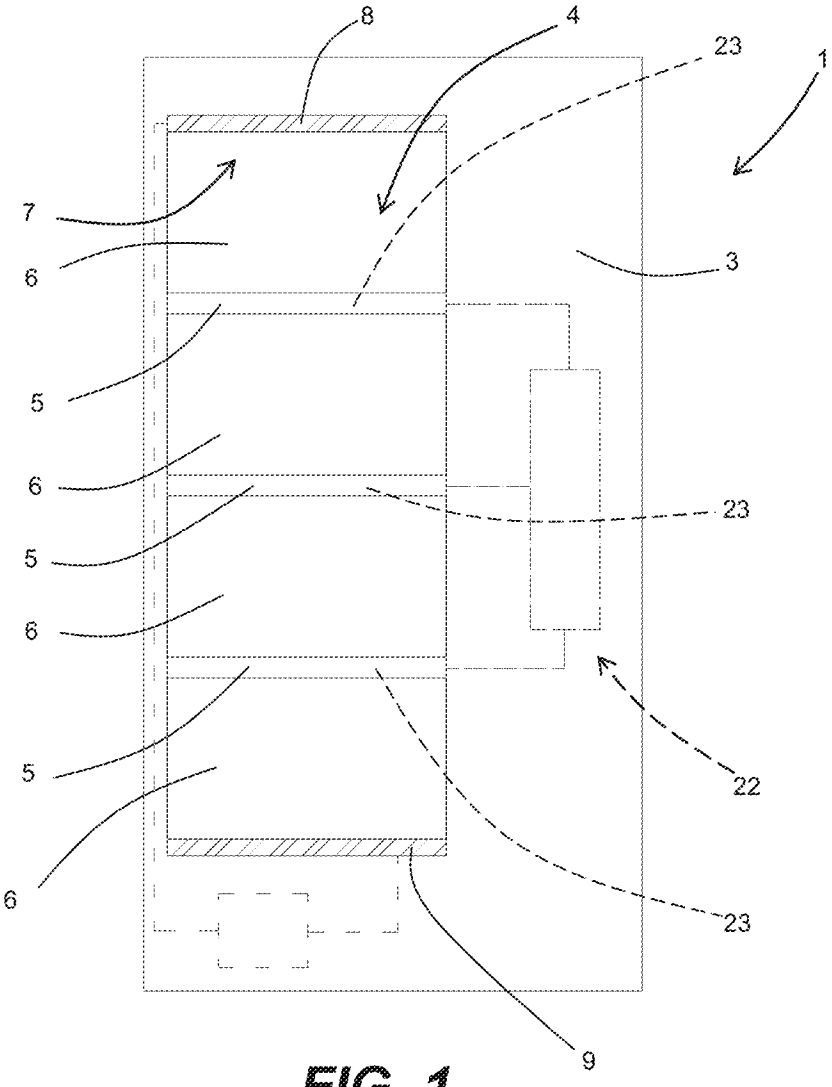
FIG. 1 is a schematic front view of an apparatus according to this disclosure, without an access door and without food products, in particular an apparatus at least for thawing food products.

Firstly, as shown in FIG. 1, the apparatus 1 comprises a containment structure 3, the inside of the structure forming a housing chamber 4. Although not illustrated in the accompanying figures, the containment structure 3 is equipped with at least one openable and closable access door which, in the known way, is designed to allow, if open, or prevent, if closed, user access to the housing chamber 4. Advantageously, in the preferred embodiments the containment structure 3 is similar to that of a common refrigerator.

One or more separating elements 5 are mounted in the housing chamber 4, and delimit in the housing chamber 4 a plurality of separate housing compartments 6 for receiving the food products 2. The housing compartments 6 are aligned at least along a first direction and so form a row of housing compartments 6 that extends from a first housing compartment 61 to a final housing compartment 62. In the preferred embodiments, the housing compartments 6 may advantageously either all be substantially the same size along the first direction or all be substantially the same three-dimensional size.

Moreover, in the preferred embodiment, the housing compartments 6 are vertically aligned and the separating element 5 extend horizontally and form shelves for supporting the food products 2 in the various housing compartments 6. However, in other embodiments other arrangements of the housing compartments 6 are also possible. In general, the one or more separating elements 5 extend at least mainly perpendicularly to the first direction along which the housing compartments 6 are aligned.

Consequently, according to this disclosure, the apparatus 1 comprises a minimum of two housing compartments 6 separated by a single separating element 5, whilst there is no maximum number of housing compartments 6 even if, requirements relating to dimensions and heating effectiveness could make applications with an high number of aligned compartments not very significant.

The apparatus 1 also comprises radio frequency dielectric heating means 7 mounted in the containment structure 3 and designed to operate at the housing chamber 4. Said radio frequency dielectric heating means 7 comprise first at least one first electrode 8 and one second electrode 9. Preferably, the first electrode 8 and the second electrode 9 each extend mainly in a plane perpendicular to the first direction. They are also facing each other and the one or more separating elements 5 that are all positioned between the first electrode 8 and the second electrode 9. In fact, the first electrode 8 and the second electrode 9 delimit the row of housing compartments 6 on two opposite sides. In particular, the first housing compartment 61 is delimited, on two opposite sides, respectively by the first electrode 8 and by a separating element 5, whilst the final housing compartment 62 is delimited, on two opposite sides, respectively by the second electrode 9 and by a separating element 5.

The radio frequency dielectric heating means 7 comprise a power supply device 10, electrically connected to the first electrode 8 and to the second electrode 9, for applying between them a variable electric potential difference with an operating frequency of between 1 MHz and 300 MHz. As regards the intensity of the voltage applied, it may be selected according to requirements, and it may be either constant or variable. The power supply device 10 preferably comprises both a generator of the electric potential difference (power supply voltage) with a frequency equal to the selected operating frequency, and a device for matching and power factor correction of the impedance of the load seen by the generator. In the known way, said load impedance matching and power factor correction device will have to also take into account the internal impedance of the generator (in many cases equal to 50Ω.

According to a further aspect of this disclosure, inside the housing chamber 4, between the first electrode 8 and the second electrode 9, there is also at least one inductor 11. Said inductor 11 is made and positioned in such a way as to be affected by the variable electromagnetic field that in use is generated between the first electrode 8 and the second electrode 9 when they are powered by the power supply device 10 at the operating frequency. In this way, the at least one inductor 11 is an inductive electric load for the power supply device 10.

Moreover, advantageously, the at least one inductor 11 is positioned at least at a first separating element 5, preferably within the dimensions of the latter.

Moreover, in the preferred embodiments, between the first electrode 8 and the second electrode 9 there is a plurality of inductors 11, positioned in such a way that the respective inductances may be considered connected in series in the electric circuit powered by the power supply device 10. In particular, in the embodiments such as that illustrated, the apparatus 1 comprises at least as many inductors 11 as there are separating elements 5, preferably positioned one at each separating element 5 (for example, within the related dimensions). Especially in the latter case, it is also possible to have an additional inductor 11 even at the air space 12 separating the upper electrode of the row (the first electrode 8 in the accompanying drawings) from the food product 2 positioned in the housing compartment 6 delimited by it (first housing compartment 61 in the accompanying drawings).

Figure 3:
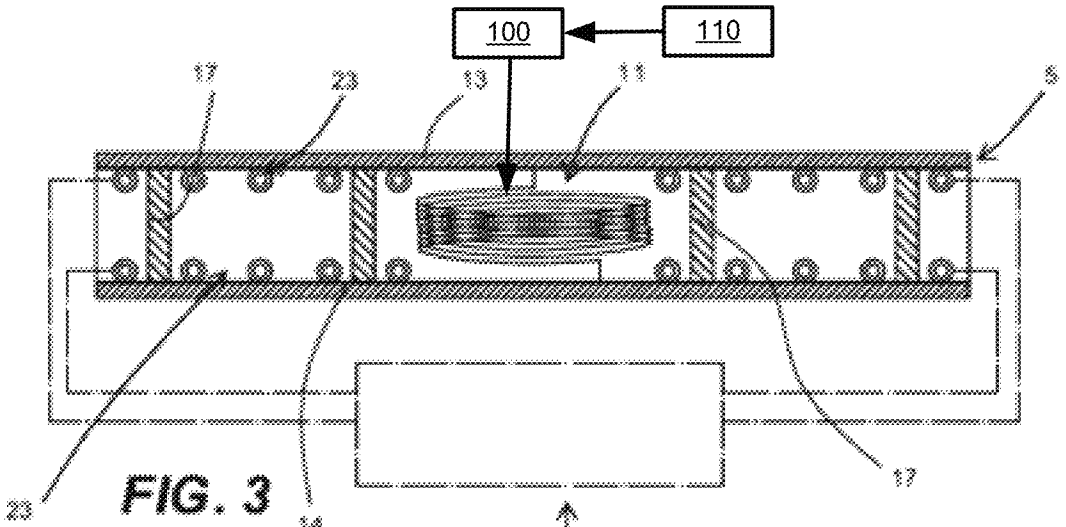
FIG. 3 is a schematic front view and cross-section of a separating element of the apparatus of FIG. 1.

As shown in FIG. 3, in one embodiment the inductor 11 is constituted of a coil of electric conductor wire, advantageously externally insulated. The coil is wound around a main axis positioned or positionable parallel to the first direction, in such a way as to maximize the magnetic field generated between the first electrode 8 and the second electrode 9, linked by the inductor 11.

In particular, in the embodiment illustrated in FIG. 3, the separating element 5 with which an inductor 11 is combined comprises a first conductive element 13 and a second conductive element 14 which extend mainly perpendicularly to the first direction, which are held at a distance from each other along the first direction (by suitable spacers 17 that are not electrically conductive), and which are facing the two adjacent housing compartments 6 separated by the separating element 5. The inductor 11 is electrically connected in series between the first conductive element 13 and the second conductive element 14. In use, the first conductive element 13 and the second conductive element 14 may have any structure suitable for the purpose. For example, they may be constituted of flat pierced or solid plates, of grilles, of a plurality of bars, etc.

The inductor 11 may be sized in any way, according to requirements and design choices. In particular, even according to how many inductors 11 there are in the housing chamber 4.

In fact, in some embodiments of the apparatus 1, the one or more inductors 11 may be sized in such a way that each of them or all of them together are able to substantially compensate for some or all of the capacitive impedances present in use in the housing chamber 4. Which elements of the housing chamber 4 are such that they constitute capacitive impedances is obvious in FIG. 2: in fact, the assembly of the first electrode 8 and the second electrode 9 constitutes a capacitor inside which different materials are contained one after another, including, in particular, the material that constitutes the food products 2, the air present in the separating zones 15 between the food products 2 (each comprising a separating element 5 and the band of air 16 that separates it from the adjacent food product 2) and the air present in the air space 12 between the food products 2 and the electrodes 8, 9 (in particular, the upper one in the embodiment shown in FIG. 2). Said capacitor may therefore also be interpreted as a plurality of capacitors connected in series, in each of which there is only one dielectric material (therefore, to a first approximation, a plurality of capacitors inside which only the food product 2 is found, and a plurality of air capacitors, as shown in the circuit diagram in FIG. 4—described in more detail below).

Considering that, it is possible that the one or more inductors 11 compensate for different elements, for example either only the impedances that correspond to the air capacitors (in themselves unwanted in a theoretical apparatus 1), thereby leaving compensation (power phase correction) of the capacitive impedances due to the food products 2 to the matching and power phase correction device, or the entire capacitive impedance present between the first electrode 8 and the second electrode 9. Furthermore, it is possible to compensate for a predetermined impedance with a single inductor 11 or with a plurality of inductors 11 in series. In the latter case, each inductor 11 may only compensate for a nth fraction of the impedance, where n is the total number of inductors 11.

What is described above in the preferred embodiments may be implemented by ensuring that each inductor 11 has an impedance whose imaginary part has an absolute value of between 0.5 and 2 times the absolute value alternatively:

- of an imaginary part of an impedance of, in use, each of the one or more separating elements 5, considered either alone or with the band of air 16 that separates it from the food products 2; or
- of an imaginary part of an impedance of, in use, jointly a plurality of separating elements 5 (where there are two or more separating elements 5); or
- of an imaginary part of a total impedance that, in use, is present between the first electrode 8 and the second electrode 9; or
- of an imaginary part of an impedance equal to the total impedance which, in use, is present between the first electrode 8 and the second electrode 9, divided by the number of housing compartments 6.

Figure 2:
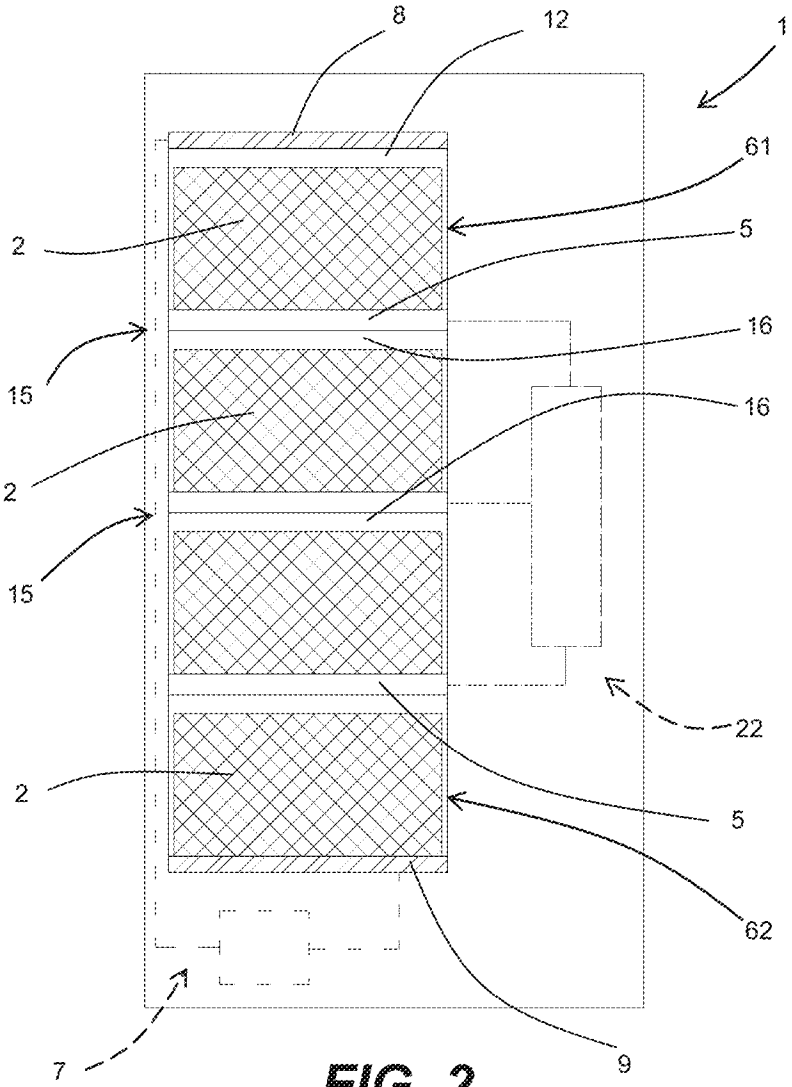
FIG. 2 is a schematic view of the apparatus of FIG. 1 loaded with food products.
Figure 4:
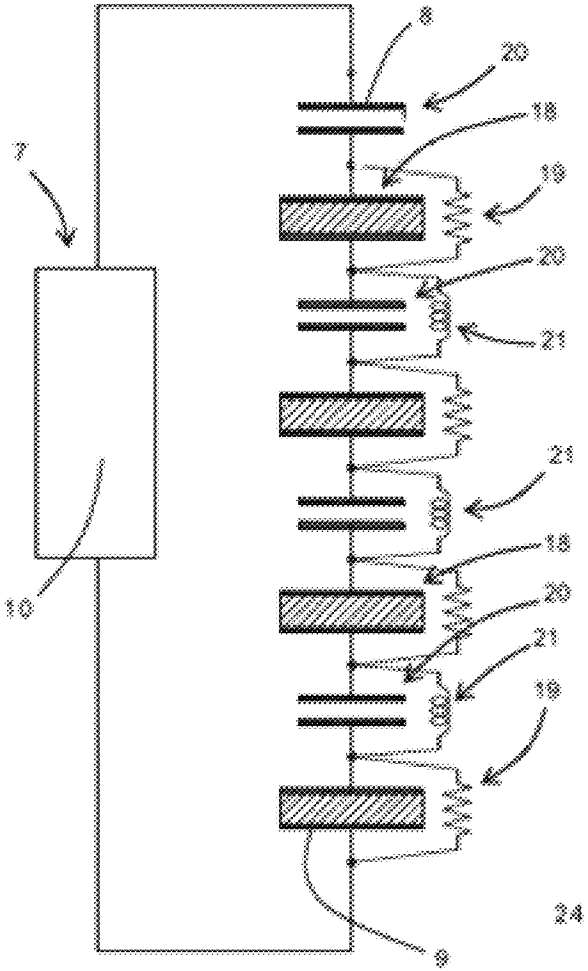
FIG. 4 shows an electric circuit representative of the apparatus of FIG. 2.

FIG. 4 shows a circuit diagram of the radio frequency dielectric heating means 7 of the apparatus 1 of FIG. 2. The circuit comprises on one side the power supply device 10, and on the other side the electric load constituted of the first electrode 8 and the second electrode 9 with everything that in use is located between them.

The electric load, in use, may be schematically illustrated as the series of the impedances constituted of the food products 2 and of those constituted of the air spaces (and/or of the other materials) present between the various food products 2 (including inductors 11). The impedances of the food products 2 may be represented as the parallel connection of a first ideal capacitor 18 (which contributes to the imaginary part of the related impedance) and of an ideal resistor 19 (which contributes to the real part of the related impedance). In the case of the apparatus 1 of FIG. 2 in which each separating element 5 is made as illustrated in FIG. 3, in their turn the impedances of the separating zones 15 between the various food products 2, and of the space 17 present between the upper food product 2 and the first electrode 8, may be likened to a second ideal capacitor 20 (in this case, the real part of the impedance may be ignored, since it is very small). Finally, each inductor 11 may be shown with an ideal inductance 21 (in this case too, the real part of the impedance may to a first approximation be ignored, since it is small) connected in parallel to the second ideal capacitor 20.

Although in the embodiment illustrated the inductor 11 is an inductor 11 with constant inductance, in other embodiments, not illustrated, it is also possible that it may be an inductor 11 with adjustable inductance. For example, the inductor 11 may be associated with a movable ferrite core which may therefore be moved to vary its electromagnetic coupling to the inductor 11. Or the inductor 11 may be deformed and/or shifted to vary its coupling (linkage) with the electromagnetic field generated between the two electrodes. In accordance with the latter method, for example, if the inductor 11 is constituted of a coil, then variation of the inclination of the main axis is possible.

Furthermore, in the case of an inductor 11 with adjustable inductance, the apparatus 1 may also comprise a motor-driven device 100 for adjusting the inductance of the at least one inductor, and an electronic control system 110 operatively connected to the motor-driven device 100 for controlling and checking its operation. The electronic control system 110 may be operatively connected to a general management system for the apparatus 1, for checking the inductance of the inductors 11 depending, for example, on parameters measured.

In the preferred embodiments intended for thawing food products 2, the apparatus 1 also comprises a refrigerating circuit 22 associated with the housing chamber 4 for refrigerating it, advantageously for keeping it at a temperature of between 0° C. and 2° C., especially in order to prevent excessive overheating of the food products 2 during thawing and to preserve the food products 2 after thawing. Depending on the embodiments, the refrigerating circuit 22 may adopt various forms, in particular as regards the positioning of the evaporator or evaporators 23. In several advantageous embodiments, the refrigerating circuit 22 comprises at least one evaporator 23 positioned in at least one of the one or more separating elements 5. In the embodiment illustrated in the accompanying FIGS. 1 to 4, it comprises at least one evaporator 23 in each of the separating elements 5 (two in FIG. 3).

Whilst in the apparatus 1 of FIG. 1 the separating elements 5 are fixed and in a constant position along the first direction, in other embodiments it is also possible that the separating elements 5 are removable and/or that they are movable for varying the dimensions of the individual housing compartments 6. In the latter case, it is also possible that they are movable both for varying the size of all of the housing compartments 6 simultaneously and for varying the size of only one or more of them.

Figure 5:
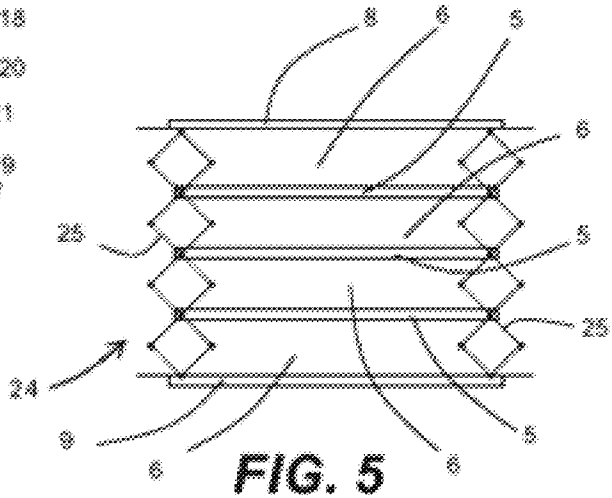
FIGS. 5 and 6 show, in two operating configurations, a possible supporting structure usable in the apparatus of this disclosure for allowing simultaneous variation, and in the same way, of the size of all of the housing compartments.
Figure 6:
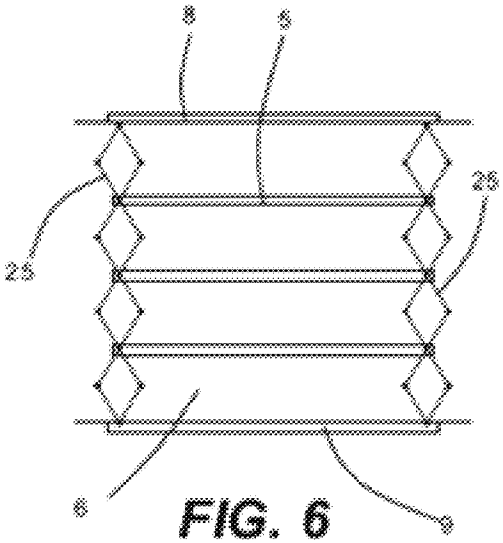

FIGS. 5 and 6 show, by way of conceptual example, a possible supporting structure 24 mountable inside the containment structure for supporting the separating elements 5, and such that it allows simultaneous variation of the position of all of the separating elements 5. Said supporting structure 24 comprises two extendable supporting legs 25, of the four-bar linkage type.

When the size of the compartments can be varied, advantageously also at least one of either the first electrode 8 or the second electrode 9 is movable relative to the other in order to vary the distance between them along the first direction. In FIGS. 5 and 6 that is achieved by also mounting the first electrode 8 on the supporting structure 24.

It should also be noticed that the supporting structure 24 in FIGS. 5 and 6 may also be used to increase the height of the housing compartments 6 during the steps of inserting and removing the food products 2, and to minimize it during heating (for example by making the various separating elements 5 substantially rest on the food products 2 below—except for the dimensional tolerances between the various food products 2).

Operation of the apparatus 1 according to this disclosure in general comprises, first, insertion of the food products 2 in the apparatus 1, preferably occupying all of the housing compartments 6.

Once the access door has been closed, the radio frequency dielectric heating means 7 are activated, to generate heat directly inside the food products 2. Advantageously, if the apparatus 1 is equipped with the refrigerating circuit 22 because it is intended for thawing, and if the selected thawing speed requires it, the refrigerating circuit 22 is activated to keep the temperature in the housing chamber 4 at approximately 0° C.-2° C. and so to prevent possible unwanted overheating of the surface portion of the food products 2, where most of the thermal energy generated by the radio frequency dielectric heating means 7 is concentrated.

This disclosure brings important advantages.

First, the apparatus according to this disclosure allows the products to be thawed more rapidly than the prior art apparatuses, but, especially in the case in which the refrigerating circuit is also present, always in a controlled way, that is to say, avoiding excessively overheating them even in the case of particularly rapid thawing operations.

Furthermore, thanks to the special structure of the apparatus which on one hand has a plurality of compartments aligned along the first direction, and on the other hand is equipped with one or more inductors located inside the housing chamber, it is possible to obtain performance that is notably better even than the prior art thawing devices that use dielectric loss. Positioning multiple food products in a row allows an increase in the real part of the impedance offered by the load, notably facilitating its matching relative to the internal resistance of the generator. Moreover, with a real part of the overall impedance higher than in prior art devices, it is also possible to notably increase the electric efficiency of the heating. The presence of the one or more inductors 11 in contrast allows complete or partial compensation for the capacitive component of the load, reducing the need for power factor correction and limiting the reactive power involved.

Finally, it should be noticed that this disclosure is relatively easy to produce and that even the cost linked to its implementation is not very high.

The disclosure described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. An apparatus for simultaneously heating a plurality of food products, comprising:

a containment structure that inside it forms a housing chamber and that is equipped with at least one openable and closable access door for allowing or not access from the outside to the housing chamber;

one or more separating elements mounted in the housing chamber, the separating elements delimiting in the housing chamber a plurality of separate housing compartments for receiving the food products;

radio frequency dielectric heating means, mounted in the containment structure and, in turn, comprising at least one first electrode and one second electrode, and a power supply electrically connected to them for applying between the first electrode and the second electrode a variable electric potential difference with an operating frequency of between 1 MHz and 300 MHz;

wherein the housing compartments are aligned along a first direction and form a row of housing compartments that extends from a first housing compartment to a final housing compartment;

the one or more separating elements extend mainly perpendicularly to the first direction;

the first electrode and the second electrode each extend mainly in a plane perpendicular to the first direction, face each other and the one or more separating elements and delimit on two opposite sides the row of housing compartments;

the separating elements are positioned between the first electrode and the second electrode;

the first housing compartment is delimited, on two opposite sides, respectively by the first electrode and by a separating element;

the final housing compartment is delimited, on two opposite sides, respectively by the second electrode and by a separating element; and inside the housing chamber, between the first electrode and the second electrode, there is also at least one inductor.

2. The apparatus according to claim 1, wherein the at least one inductor is made and positioned in such a way as to be affected by a variable electromagnetic field that is generated between the first electrode and the second electrode when they are powered by the power supply at the operating frequency and in such a way as to be an inductive electric load for the power supply.

3. The apparatus according to claim 1, wherein the at least one inductor comprises a coil of externally insulated electric conductor wire.

4. The apparatus according to claim 3, wherein the coil is wound around a main axis that is parallel to the first direction.

5. The apparatus according to claim 1, wherein, relative to the variable electromagnetic field that is generated between the first electrode and the second electrode powered by the power supply at the operating frequency, the at least one inductor has an impedance whose imaginary part has an absolute value of between 0.5 and 2 times the absolute value of an imaginary part of an impedance of, in use, each of the one or more separating elements.

6. The apparatus according to claim 1, wherein the at least one inductor is an inductor with adjustable inductance.

7. The apparatus according to claim 6, further comprising a motor-driven device for adjusting the inductance of the at least one inductor, and an electronic control system operatively connected to the motor-driven device for controlling and checking operation of the motor-driven device.

8. The apparatus according to claim 1, wherein the at least one inductor is positioned within a first separating element.

9. The apparatus according to claim 1, wherein the first separating element comprises a first conductive element and a second conductive element which extend mainly perpendicularly to the first direction, which are held at a distance from each other along the first direction and which are facing two adjacent housing compartments that are separated by the first separating element, the at least one inductor being electrically connected in series between the first conductive element and the second conductive element.

10. The apparatus according to claim 9, wherein at least one inductor is disposed within each separating element.

11. The apparatus according to claim 1, further comprising a refrigerating circuit associated with the housing chamber for refrigerating the housing chamber.

12. The apparatus according to claim 11, wherein the refrigerating circuit comprises at least one evaporator positioned in at least one of the one or more separating elements.

13. The apparatus according to claim 1, wherein the separating elements are movable for varying the dimensions of the individual housing compartments.

14. The apparatus according to claim 1, wherein at least one of either the first electrode or the second electrode is movable relative to the other for varying the distance between them along the first direction.

15. The apparatus according to claim 1, wherein all of the housing compartments are either the same size along the first direction or the same three-dimensional size.

16. The apparatus according to claim 1, wherein, relative to the variable electromagnetic field that is generated between the first electrode and the second electrode powered by the power supply device at the operating frequency, the at least one inductor has an impedance whose imaginary part has an absolute value, where there are two or more separating elements present, of between 0.5 and 2 times the absolute value of an imaginary part of an impedance of, in use, jointly a plurality of separating elements.

17. The apparatus according to claim 1, wherein, relative to the variable electromagnetic field that is generated between the first electrode and the second electrode powered by the power supply device at the operating frequency, the at least one inductor has an impedance whose imaginary part has an absolute value of between 0.5 and 2 times the absolute value of an imaginary part of a total impedance that, in use, is present between the first electrode and the second electrode.

18. The apparatus according to claim 1, wherein, relative to the variable electromagnetic field that is generated between the first electrode and the second electrode powered by the power supply device at the operating frequency, the at least one inductor has an impedance whose imaginary part has an absolute value of between 0.5 and 2 times the absolute value of an imaginary part of an impedance equal to the total impedance which, in use, is present between the first electrode and the second electrode, divided by the number of housing compartments.

* * * * *